US008505612B2

(12) United States Patent
Della Vedova

(10) Patent No.: US 8,505,612 B2
(45) Date of Patent: Aug. 13, 2013

(54) ROBOTIZED SYSTEM TO MANAGE THE POWDERS IN A CONTINUOUS CASTING PLANT FOR STEEL

(75) Inventor: Ferruccio Della Vedova, Pozzuolo del Friuli (IT)

(73) Assignee: Danieli Automation SpA, Buttrio (IT)

( * ) Notice: Subject to any disclaimer, the term of this patent is extended or adjusted under 35 U.S.C. 154(b) by 0 days.

(21) Appl. No.: 13/522,332

(22) PCT Filed: Jan. 14, 2011

(86) PCT No.: PCT/IB2011/000053

§ 371 (c)(1),
(2), (4) Date: Jul. 15, 2012

(87) PCT Pub. No.: WO2011/086459

PCT Pub. Date: Jul. 21, 2011

(65) Prior Publication Data

US 2012/0273157 A1 Nov. 1, 2012

(30) Foreign Application Priority Data

Jan. 15, 2010 (IT) ..... UD2010A0006

(51) Int. Cl.
*B22D 11/108* (2006.01)
*B22D 11/16* (2006.01)

(52) U.S. Cl.
USPC ..... 164/451; 164/473

(58) Field of Classification Search
USPC ..... 164/451, 473
See application file for complete search history.

(56) References Cited

U.S. PATENT DOCUMENTS 5,360,051 A * 11/1994 Takahashi et al. ..... 164/155.3

FOREIGN PATENT DOCUMENTS

| | | | |
|---|---|---|---|
| BE | 1016114 | A3 | 3/2006 |
| DE | 3224599 | C1 | 10/1983 |
| EP | 0371482 | A2 | 6/1990 |
| JP | 8-117943 | A * | 5/1996 |

OTHER PUBLICATIONS

International Search Report from PCT/IB2011/000053 dated Jun. 28, 2011.

* cited by examiner

*Primary Examiner* — Kevin P Kerns
(74) *Attorney, Agent, or Firm* — Novak Druce Connolly Bove + Quigg, LLP

(57) ABSTRACT

A method to cover the exposures of a bath of molten steel by elements of casting powder in an ingot mold of a plant for the continuous casting of steel, including a step of subdividing the ingot mold into a desired number of zones, with each of which a covering movement is associated, the zones being determined and identified in a manner coordinated with the position of the snorkel and of the edge of the ingot mold, and a step of automated execution of one or more covering movements by elements of which the casting powder is distributed in a selected one of the zones, which movements, repeated in sequence according to a desired program, are selected from a group including pouring movements and throwing movements, at least on the basis of the reciprocal position of each of the zones and the snorkel.

11 Claims, 8 Drawing Sheets

ROBOTIZED SYSTEM TO MANAGE THE POWDERS IN A CONTINUOUS CASTING PLANT FOR STEEL

CROSS-REFERENCE TO RELATED APPLICATIONS

This application is a §371 National Stage Application of International Application No. PCT/IB2011/000053, filed on 14 Jan. 2011, claiming the priority of Italian Patent Application No. UD2010A000006 filed on 15 Jan. 2010.

FIELD OF THE INVENTION

The present invention concerns a robotized system to manage the casting powders to be distributed on a bath of molten metal in an ingot mold in a plant for the continuous casting of steel.

BACKGROUND OF THE INVENTION

The continuous casting process schematized in the plant 10 in FIG. 1 is an industrial production process of the melting type, in which the molten metal arriving from a furnace or a convertor is poured by means of a ladle 12 into a distribution container, called tundish 14, which has two tasks: the first is to block the slag that has formed during the melting process, the second is to regularize the flow of steel intended for subsequent processes. From the tundish 14 the metal passes due to gravitational force through a cylindrical snorkel 16 made of ceramic material to a permanent mold with an open bottom called mold 18. It can have different sections and sizes, depending on whether billets, blooms or slabs are to be produced. It is generally built of copper and cooled externally by water; this allows the alloy to solidify in the most external part of its section, while remaining liquid internally. Its continuous vertical oscillation also prevents the metal from adhering to the walls. The solidified skin that is formed provides sufficient stability to the cast piece to allow it to descend through a curved path 20 with a diameter of some meters, during which the forced cooling continues by means of sprays of water directly on its surface. Once it has reached the horizontal position, the metal is almost completely solidified and is ready to be sheared by means of an oxyacetylene blow torch or shears, into pieces of a suitable length to be sent to subsequent processes or for direct sale. Usually a continuous casting machine has several casting lines, each equipped with an ingot mold, a cooling path and oxygen shearing and fed by a single tundish.

In particular, in the passage of the molten steel through the ingot mold 18, the alloy must be kept constantly under a layer of casting powders 15, a granular mixture consisting mainly of carbon and silicon oxides, aluminum, sodium and calcium. The casting powders have many functions:

- they lubricate the interstice that forms between the copper crystallizer and the first solidified skin consequent to the contraction of the steel due to cooling, thus reducing friction;
- they prevent contact between the meniscus and the atmosphere, preventing oxidations of the alloy;
- they reduce the upward heat dispersions, thus preventing the formation of surface solidifications.

On ingot molds with a large section, the distribution of the powders is still made manually, obliging operators to work in a dangerous and hostile environment due to the possibility of the snorkel breaking, the liquid steel overflowing from the mold, of sprays of material that infiltrates between the slide gates 19 of the ladle, and also due to the high temperatures and environmental humidity found. Furthermore, the use of human operators does not allow a homogeneous and rapid distribution of the powders in the only zones where this is actually necessary.

Document EP-A-0.371.482 describes a continuous casting method that monitors the conditions of the surface of the molten bath in an ingot mold, in particular surface anomalies such as lumps and lack of powders or the formation of crust.

Document BE-A-1.016.114 describes an automatic control method to control the lubricant powder in a mold for continuous casting.

Document DE-C-3224599 describes a tool for the distribution of lubricant powder on a mold for continuous casting. The tool functions as a dosing device since it is provided with separation walls that define compartments for the powder having different depths and therefore a different capacity for containing the powder. The geometry is coordinated with the different areas of the mold on which the different quantities of powder are to be distributed, typically depending on the heat profile of the zones of the mold. The tool can be rotated around a longitudinal axis, so as to pour the different quantities of powder simultaneously onto the various zones of the mold to be serviced. Consequently, the tool cannot be used to cover the whole surface depending on needs, performing different types of powder distribution, such as various types of throwing or pouring, in a sequential manner in different zones of the mold that require variable approach dynamics. Furthermore, it cannot conserve, for each covering movement to be performed subsequently, an adequate and desired quantity of powder.

One purpose of the present invention is to achieve a robotized and automatic system to manage the distribution of the powders in a mold which increases safety for the operators, who are no longer obliged to work in high-risk places, which improves the quality of the product, keeping the free surface of the steel constantly under a layer of powder with a uniform thickness and as thin as possible, and allows to reduce the consumption of the casting powder.

Another purpose is to adopt a suitable viewing system to detect the zones to be serviced and a robot manipulator for the operations to distribute the powders.

Another purpose is to optimize the suitable distribution techniques of the casting powders.

Another purpose is to develop viewing algorithms able to identify quickly the zones of the bath where it is necessary to deliver material, called exposures.

Another purpose is to allow interaction with each other of the systems adopted, allowing to calibrate the viewing system, to detect the zones of the meniscus exposed to the air, to communicate the data to the robot controller, to load the casting powder and subsequently distribute it.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

According to one feature of the present invention, a method to cover the exposures of a bath of molten steel by means of casting powder in an ingot mold of a plant for the continuous casting of steel into which the molten steel is introduced by means of a snorkel disposed in a substantially central position in the mold and connected to a tundish, comprises:

a step of dividing the mold into a desired number of zones with each of which a determinate type of covering movement is associated, performed to distribute the powders on the exposures, said zones being determined and identified in a manner coordinated with the position of the snorkel and the edge of the ingot mold, determining at least zones distanced from the snorkel and near the edge of the mold, zones close to the snorkel with respect to the edge of the mold and/or in a position opposite the snorkel with respect to a desired common point of the mold and at least a zone in such a position that the bulk of the snorkel hinders the zone being reached;

a step of automated execution of one or more covering movements by means of which the casting powder is distributed in a selected one of said zones. The movements, repeated in sequence according to a desired program, are selected from a group comprising types of pouring movements and throwing movements, at least on the basis of the reciprocal position between each of said zones and the snorkel.

The covering movements are performed starting from the common point of the mold, displacing the powder from said common point toward an approach point selected so as to have at least a first spatial coordinate that disposes it on the edge of the mold and a second spatial coordinate in common with the region of the mold in which the zone to be serviced is to be found, and the movement of final covering proper is performed from the approach point, typically by pouring or throwing.

The method according to the present invention provides both a step of displacing to a reloading position where a powder reloading step is performed and also, once the reloading step is concluded, a step of displacement to said common point of the mold from which said covering movements are again performed.

The method according to the present invention also provides to discern exposures with respect to flames, sparks or other visual disturbances present on the bath of molten steel, effecting:

a step of acquiring a plurality of images of the surface of the molten bath;

a step of applying a non-linear temporal filtering technique of the pixels of the images acquired, based on M-SD (Mean-Standard Deviation) filtering, which provides to calculate the development of the mean and standard deviation of the intensity of each pixel, on a temporal window of a desired amplitude and a thresholding, considering exposed the points relating to all the pixels with a mean intensity above a determinate threshold value and with a standard deviation lower than another determinate threshold value.

According to advantageous forms of embodiment of the invention, at least the zones close to the snorkel with respect to the edge of the mold and/or in the position opposite the snorkel with respect to said common point of the mold, or in an opposite position impeded by the bulk of the snorkel and therefore not reachable without interfering with the snorkel, are covered by throw movements of the casting powders.

In some forms of embodiment, the throw movements comprise a frontal throw, a lateral throw or whip throw, as shown in more detail hereafter in the description.

Preferential forms of embodiment provide, at least for covering the zone obscured or eclipsed by the snorkel, to execute movements of whip throw.

In some forms of embodiment of the present invention, discerning the exposures provides a temporal processing of several images acquired at subsequent times, calculating the mean and standard deviation of the intensity of each pixel on a video sequence of some frames and carrying out a thresholding by putting all the pixels equal to one, with a mean intensity above a certain threshold and a standard deviation lower than another threshold, wherein the pixels of the image relating to the snorkel that still appears in the processed image are eliminated from the subsequent processings based on the known spatial position of the snorkel, thanks to the use of the perspective projection matrix associated with the mold.

The present invention also concerns an apparatus for covering the exposures of a bath of molten steel by means of casting powders in a mold of a plant for the continuous casting of steel into which the molten steel is introduced by means of a snorkel disposed in a substantially central position in the mold and connected to a tundish.

The apparatus according to the present invention comprises electronic means to divide the mold into a plurality of zones, with each of which a determinate type of covering movement is associated, carried out by means of covering means to distribute the powder on the exposures, said zones being determined and identified in a manner coordinated with the position of the snorkel and the edge of the mold, determining at least zones distanced from the snorkel and near the edge of the mold, zones close to the snorkel with respect to the edge of the mold and/or in a position opposite the snorkel with respect to a desired common point of the mold and at least a zone in such a position that the bulk of the snorkel hinders it from being reached.

The apparatus comprises means for the automatic execution of one or more covering movements by means of which the casting powder is distributed in a selected one of said zones. The movements, repeated in sequence according to a desired program, are selected from a group comprising types of pouring movements and throwing movements, at least on the basis of the reciprocal position between each of said zones and the snorkel, the covering movements being performed starting from the common point of the mold, displacing the powder from said common point toward an approach point selected so as to have at least a first spatial coordinate that disposes it on the edge of the mold and a second spatial coordinate in common with the region of the mold in which the zone to be serviced is to be found, and from the approach point the movement of final covering proper is performed.

The means for the automatic execution of one or more covering movements are configured to determine the displacement of the covering means both to a loading position where a powder reloading means are provided and also, once the reloading step is concluded, to said common point of the mold from which said covering movements are again performed.

The apparatus according to the present invention is also configured to discern exposures with respect to flames, sparks or other visual disturbances present on the bath of molten steel, comprising:

means for acquiring a plurality of images of the surface of the molten bath;

electronic processing means suitable for the application of a non-linear temporal filtering technique of the pixels of the images acquired, based on M-SD (Mean-Standard Deviation) filtering, which provides to calculate the development of the mean and standard deviation of the intensity of each pixel, on a temporal window of a desired amplitude and a thresholding, considering exposed the points relating to all the pixels with a mean intensity above a determinate threshold value and with a standard deviation lower than a further determinate threshold value.

According to another feature of the present invention, a method for covering the exposures of a bath of molten steel by means of casting powders in a mold of a plant for the continuous casting of steel conformed to identify and cover occlusions, that is, zones not visible by an automatic viewing system, of the bath of molten steel comprises:

a step of acquiring a plurality of images of the surface of the molten bath;

a step of identifying visible zones and occluded zones, comprising the shadow zones defined by the snorkel and by the edge of the ingot mold, on the image acquired;

a step of defining a matrix of test points lying on the free surface of the bath of molten steel and projected onto an image plane associated with said acquired image, said points all being associated with univocal spatial coordinates, known and defined in advance;

a step of counting the points belonging to the visible zones;

a step of determining the value of the ratio v between the number of points included in the occluded or non-visible zones, and the overall points n of the matrix of the test points, in order to provide an indication of the entity of the occluded zones so as to guide the choice of the frequency with which these are covered;

a step of defining a law for filling a work queue of points waiting to be covered with the casting powder, which filling law provides that, as a function of said ratio v, for every n queue elements there are $p_v$, visible and $p_o$ occluded, wherein the choice of the order in which said non-visible points are inserted in said work queue is made in a pseudo-random manner, calculated at the beginning of the method by means of a random permutation of the table of ordered data or array, which contains said non-visible points, and wherein, once a point is covered, it is returned to the queue, so as to determine a cyclical and homogenous covering of the occluded zones.

According to some forms of embodiment of the present invention, the value of $p_v$ is put as equal to $(1-v)*n$, whereas the value of $p_o$ is put as equal to $v*n$.

With this method according to the present invention, since it is known that statistically, on a given temporal base (for example one hour), there will be a homogeneous number of exposures on the surface of the bath of molten metal, it is certain that on the same temporal base an adequate and correct quantity of casting powder will be distributed, needed to compensate for the number of exposures statistically expected.

The present invention also concerns an apparatus for covering the exposures of a bath of molten steel by means of casting powders in a mold of a plant for the continuous casting of steel conformed to identify and cover occlusions, that is, zones not visible by an automatic viewing system, of the bath of molten steel and comprising:

means for acquiring at least one image of the surface of the molten bath;

electronic means for identifying visible zones and occluded zones, comprising the shadow zones defined by the snorkel and by the edge of the ingot mold, on the image acquired;

electronic means for defining a matrix of test points lying on the free surface of the bath of molten steel and projected onto an image plane associated with said acquired image, said points all being associated with univocal spatial coordinates, known and defined in advance;

means for counting the points belonging to the visible zones;

electronic means for determining the value of the ratio v between the number of points included in the occluded or non-visible zones, and the overall points n of the matrix of the test points, in order to provide an indication of the entity of the occluded zones so as to guide the choice of the frequency with which these are covered;

electronic means for defining a law for filling a work queue of points waiting to be covered with the casting powder, which filling law provides that, as a function of said ratio v, for every n queue element there are $p_v$, visible and $p_o$ occluded, wherein the choice of the order in which said non-visible points are inserted in said work queue is made in a pseudo-random manner, calculated at the beginning of the method by means of a random permutation of the table of ordered data or array, which contains said non-visible points, and wherein, once a point is covered, it is returned to the queue, so as to determine a cyclical and homogenous covering of the occluded zones.

According to another feature of the present invention, a tool is provided for the distribution of the casting powders, advantageously associable with a robotized manipulator, which is used to perform the covering movements by means of pouring or throwing as above.

The distribution tool comprises a containing body or box with which the casting powder is transported, which is conformed to allow the distribution of the casting powder by means of pouring or throwing movements, or both of said movements.

The containing body or box is divided into a plurality of compartments or chambers which are geometrically configured for use with at least two different covering movements for the distribution of the powder in different zones of the bath of molten steel to be serviced. Separation means are provided to separate the chambers or compartments from each other. The separation means are disposed in a manner coordinated with the type of covering movement associated with at least one of the chambers or compartments so as to allow that, in the course of at least a first covering movement, a first quantity of powder is distributed, contained in one of said chambers or compartments, whereas a second quantity of powder, contained in the other of said chambers or compartments, is withheld so as to be used in the course of at least a second covering movement, different from the first covering movement.

The distribution tool is advantageously conformed as a blade, and can be attached to the robotized manipulator directly or by means of a rod or bar.

According to one form of embodiment of the present invention, particularly suitable for use in molds for the production of slabs or blooms, the containing body or box has a first main chamber, open at the top, by means of which the casting powder is distributed with a pouring movement, and a second head chamber, open both at the top and at the front, by means of which the powder is distributed with throwing movements as described above.

In some forms of embodiment of the invention, the first chamber and the second chamber are separated by a transverse dividing wall which functions as a barrier disposed transverse to the direction associated with the front throwing movement with which the powder is distributed in the second chamber, thanks to which, in some throwing movements according to the present invention, it is possible to thrust forward the powder contained in the second head chamber, facilitating the exit thereof for throwing through the front aperture, at the same time preventing the powder present in the first chamber from exiting through the front.

In some forms of embodiment of the invention, preferably used in molds for the production of billets, the containing body or box has an internal chamber, divided longitudinally into two lateral longitudinal compartments by a dividing wall disposed coordinately aligned with the axis around which the containing body or box is rotated during pouring, and an upper wall with upper apertures, such as slits or windows, by means of which it is possible both to pour the casting powder onto the bath of molten steel, after the desired rotation of the containing body or box, toward the surface of the bath, and also to perform the powder reloading operations. The dividing wall and the upper wall cooperate so as to retain the powder contained in one of the two compartments when the powder contained in the other of the two compartments is distributed.

BRIEF DESCRIPTION OF THE DRAWINGS

These and other characteristics of the present invention will become apparent from the following description of a preferential form of embodiment, given as a non-restrictive example with reference to the attached drawings wherein.

Figure 1:
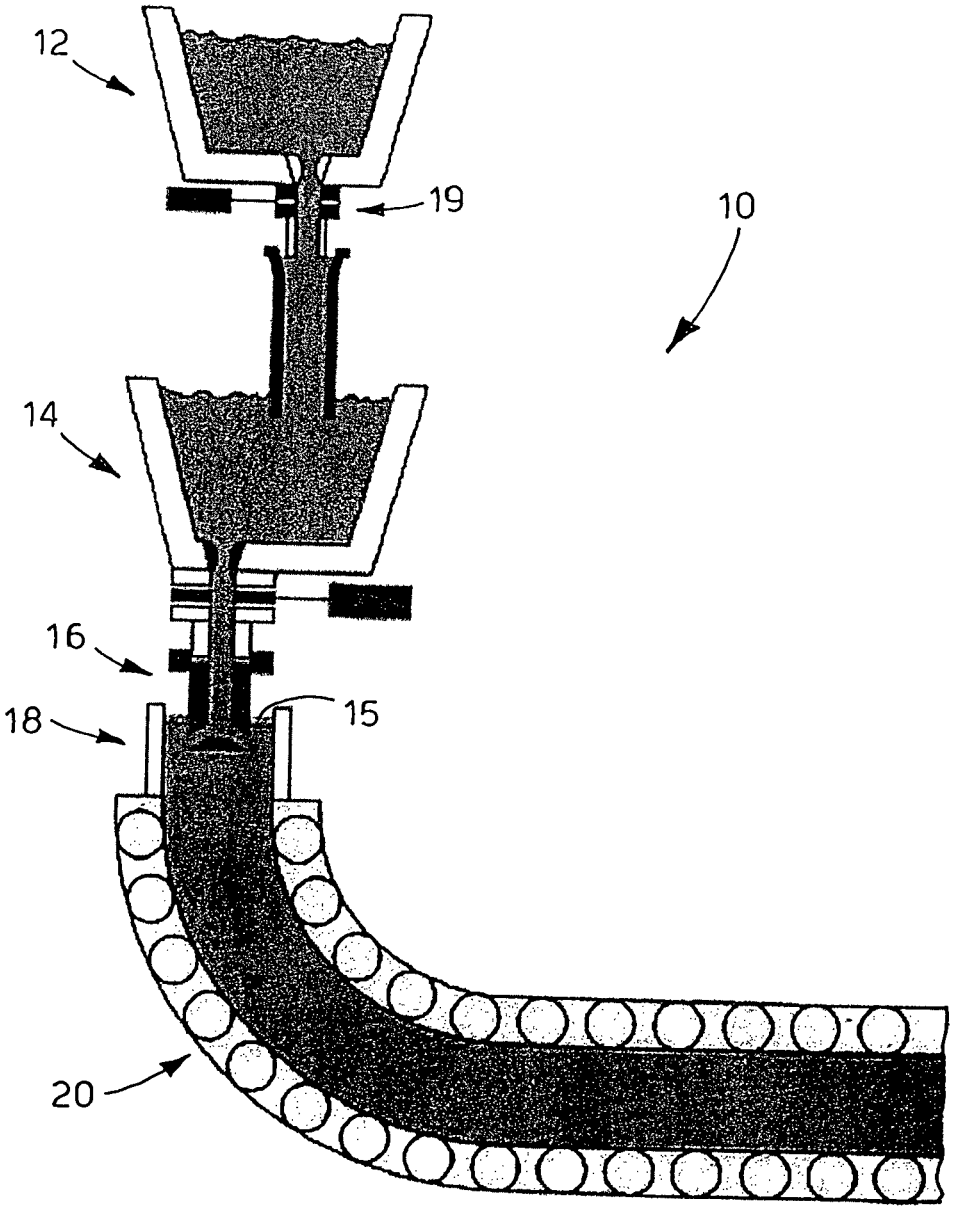
FIG. 1 is a schematic representation of the continuous casting process.

To facilitate comprehension, the same reference numbers have been used, where possible, to identify common elements in the drawings that are substantially identical. It is understood that elements and characteristics of one form of embodiment can conveniently be incorporated into other forms of embodiment without further clarifications.

DETAILED DESCRIPTION OF A PREFERENTIAL FORM OF EMBODIMENT

1) Components of the System

Figure 2:
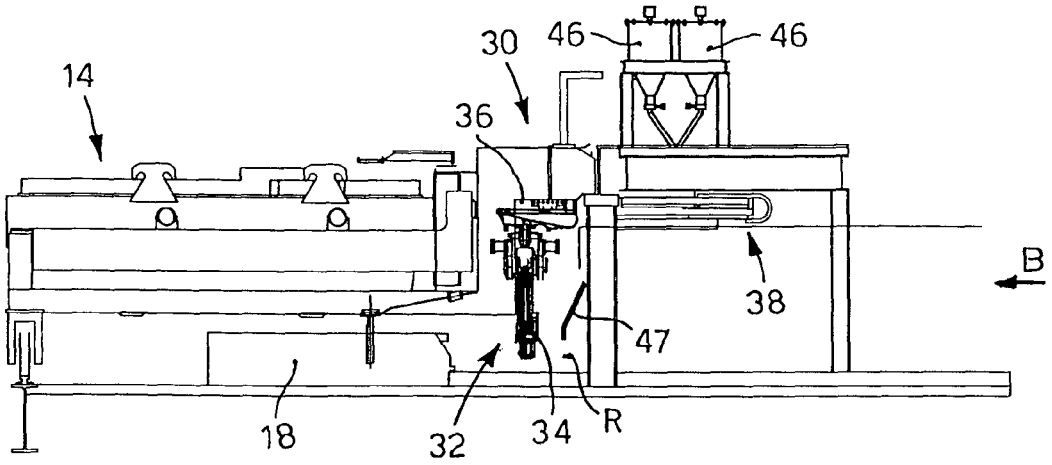
FIG. 2 is a lateral view of a system according to the present invention.
Figure 3:
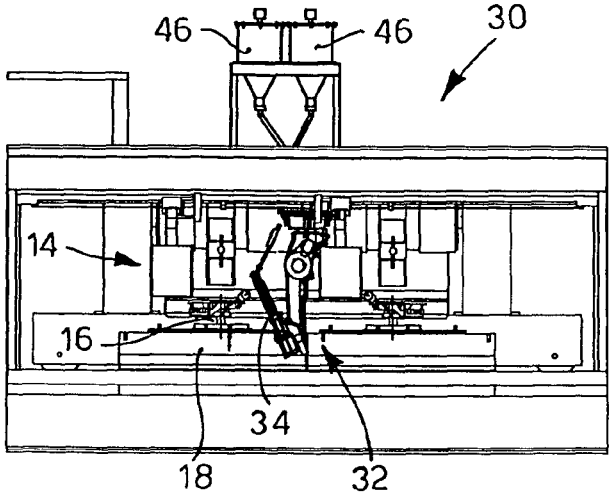
FIG. 3 is a front view in the direction indicated by the arrow B in FIG. 2.
Figure 5:
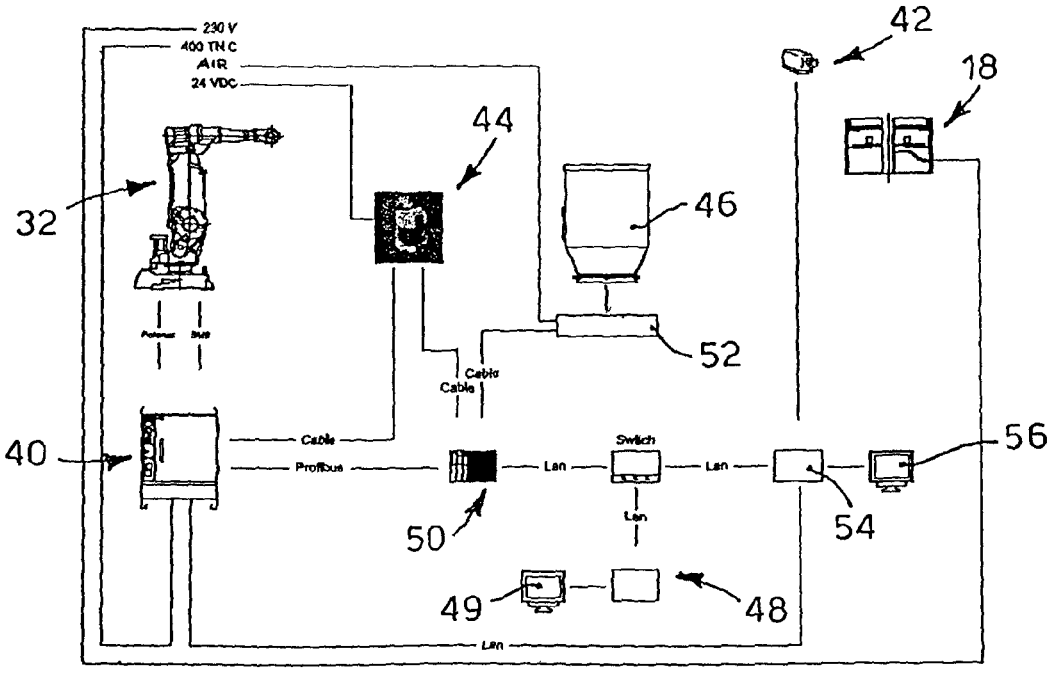
FIG. 5 is a single-wire diagram of the robotized control and powder throwing system according to the present invention.

FIGS. 2 and 3 show forms of embodiment of a robotized system 30 according to the present invention to control and throw powders in a continuous casting plant. FIG. 5 shows a single-wire diagram of the system 30.

The system 30 comprises an anthromorphous robot manipulator 32, provided with an articulated arm 34 on which a tool is mounted for the distribution and/or throwing of powders onto the bath of molten steel in the mold. In this case, the tool is a blade, advantageously in the forms of embodiment shown in FIGS. 6, 9 and 10 in the case of blooms or slabs (reference number 60), or as shown in FIGS. 12, 13, 14, 15 and 16 in the case of mold for billets (reference number 70).

In some forms of embodiment of the invention, the manipulator 32 can be installed suspended or, in other forms of embodiment, on the floor.

In FIGS. 2 and 3, the manipulator 32 is shown installed suspended to a frame, or beam, 36 and is movable from and toward the mold 18 by means of movement means 38, also suspended.

Figure 4:
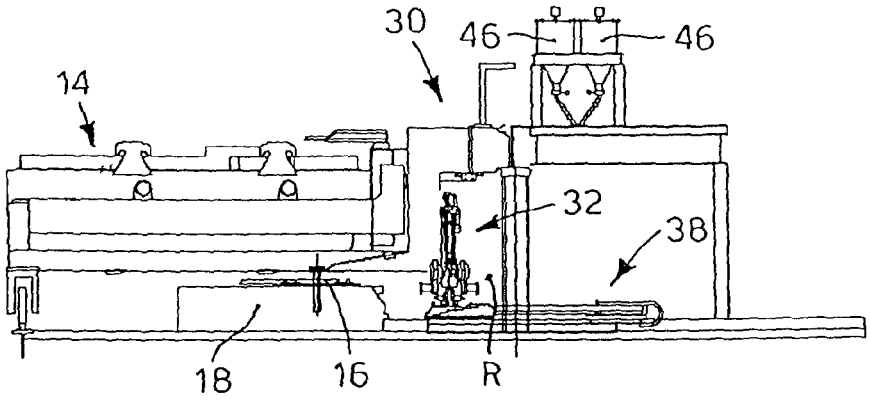
FIG. 4 is a lateral view of a variant of the system according to the present invention.

In FIG. 4, the manipulator 32 is shown fixed to the floor, also in this case mobile from and toward the mold 18 by means of movement means 38 on the floor.

When there are several molds 18 in parallel, each of them can be serviced by its own dedicated robot manipulator 32, or by a single robot manipulator 32 suitably moved between the continuous casting lines.

The system 30 also comprises a controller 40, a camera 42, to acquire images and/or video sequences of the surface of the bath of molten steel of the mold 18, a laser scanner 44 to identify intrusions into the work space of the robot, and containers or dispensers 46 to dose a controlled quantity and to deliver the casting powders into the tool or blade 60, 70. The dispensers 46 are located at the top, on the frame or beam 36. Various dispensers 46 may be provided, which contain different types of powder depending on the type of steel that is cast. The robot manipulator 32, suitably instructed, alternately picks up the desired type of powder from one dispenser 46 or the other.

We shall now describe in detail some forms of embodiment of the components of the system 30.

Manipulator 32

In some forms of embodiment, the present invention uses an anthropomorphous manipulator 32 with a spherical wrist. This category of manipulators is the one that comes closest to the characteristics of the human arm, and has six turning joints that guarantee the structure six degrees of freedom.

Figure 20:
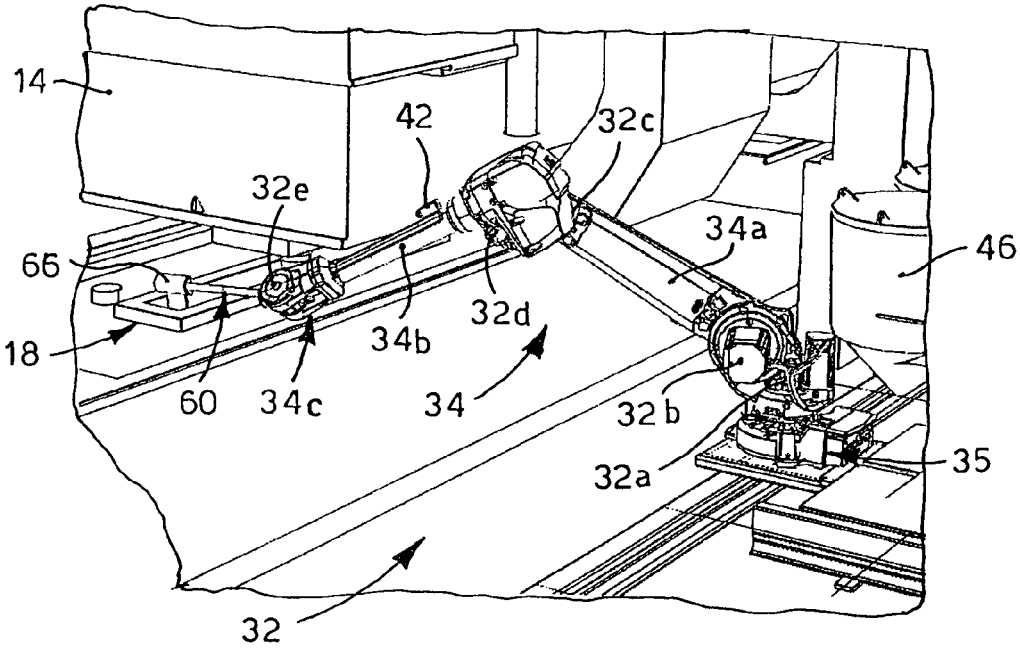
FIG. 20 shows the robotized system according to the present invention in a powder pouring step.

A first joint 32*a* (FIG. 20) allows to rotate the base body 35 of the manipulator 32 around a vertical axis, a second joint 32*b* (FIG. 20) is called the shoulder joint and articulates the base body of the manipulator 32 with the arm 34, while a third joint 32*c* (FIG. 20), called elbow joint, connects the "arm" 34*a* and "forearm" 34*b* of the structure of the arm 34.

Figure 19:
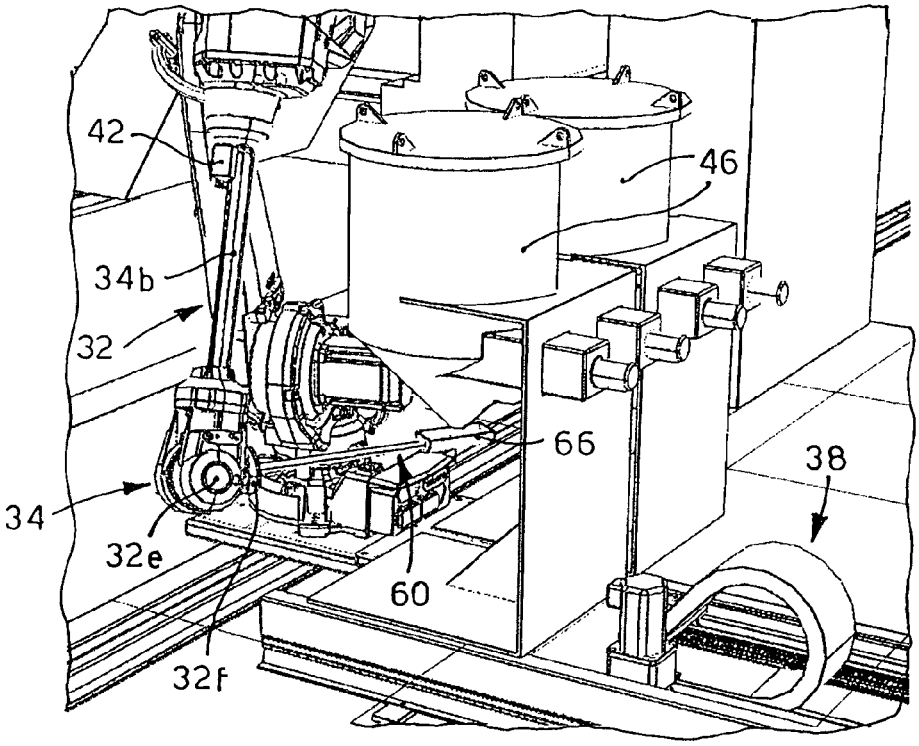
FIG. 19 shows the robotized system according to the present invention in a powder loading step.

A fourth joint 32*d* (FIG. 20) allows the articulation of the forearm 34*b* around an axis parallel to the arm 34*a*, and a fifth 32*e* and sixth 32*f* joint (FIG. 19) allow the articulation of the wrist 34*c* of the articulated arm 34 around two more axes incident with respect to the axis of the fourth joint 32*d*.

In some forms of embodiment, the robot manipulator 32 is protected by a suitable covering made of flexible material, which surrounds it, protecting it from heat, splashes of molten steel or other.

Controller 40

In some forms of embodiment, the present invention uses a controller 40 that contains the electronics needed to control the manipulator, the communication peripherals and possible external axes. It consists of the following modules:

drive module, containing the drive system for the joints;

control module, containing the computer, the operator's panel, the electric feed switch, the communication interfaces, the connection with a Teach Pendant control cloche and the service ports.

Camera 42

In some forms of embodiment, the present invention adopts a digital camera 42, equipped with a color CCD sensor and interfaceable with a PC through a LAN network.

The instant images collected are processed on a personal computer 54, exploiting proprietary and/or commercial automatic viewing libraries; the results are then communicated to the robot controller via Ethernet using the TCP/IP protocol.

In some forms of embodiment, the camera 42 is advantageously mounted on the articulated arm 34 of the manipulator 32 and is therefore mobile with it. In particular, as can easily be seen for example in FIGS. 19 and 20, the camera can be mounted on part of the forearm 34*b* and be mobile with it.

In some forms of embodiment, the camera 42 mounted on the articulated arm 34 is further directable and/or mobile with respect to the articulated arm 34.

In other forms of embodiment, the camera 42 is not mounted on the articulated arm 34.

In some forms of embodiment, the camera 42 is disposed on a fixed support and frames the ingot mold 18.

In other forms of embodiment, the camera 42 is made mobile, for example by means of a pointing device.

Laser Scanner 44

A laser scanner 44 is used as a category 3 optoelectronic safety device, able to detect the intrusion of persons and objects into the robot's work space and to send a stop command to the robot and its movement support.

Auxiliary Elements

The application is supplied with other elements able to complete the automation thereof, to fulfill all its functions: the dispensers 46 for dosing the powders, an HMI (Human-Machine Interface) 48 with relative monitor 49, a computer 54 with relative monitor 56 and a supervision PLC 50, which allow the autonomous functioning of the robotic system 30.

The dispenser 46 doses the powder into the distribution tool or blade 60, 70 through falling, thanks to a pneumatic valve 52 driven by the PLC 50 on request of the controller 40. The communication between these two elements occurs via Profibus and also involves other types of data, such as the zone of the ingot mold where an exposure has been detected, or the commands to start or stop the application.

The HMI 48 makes available a graphic environment that allows the operator to interact with the machine: it allows at least to start and stop the work cycles, and provides information on the state of the system. The HMI 48 also shows the video sequence acquired by the camera 42; in this case the signal arrives directly from the computer 54 with monitor 56 used for viewing.

2) Robotic System

2.1 Powder Dynamics

Due to the location of the manipulator 32 with respect to the mold 18, which puts a part of the latter outside the operating space, together with the need to keep the articulated arm 34 as far away as possible from the zone of the bath for safety reasons, it is necessary to cover some zones by throwing the casting powder.

Applicant has devised and developed innovative blades 60, 70 used to fulfill this purpose, studying the way in which the powders are distributed according to the characteristics of the throw, in order to assess the effectiveness of the tools and to choose the movements of the manipulator 32 appropriately.

We shall now describe some forms of embodiment of blades both for the distribution and throwing of powder in a mold for the production of blooms and slabs, and also for the distribution of powder in a mold for the production of billets.

Figure 6:
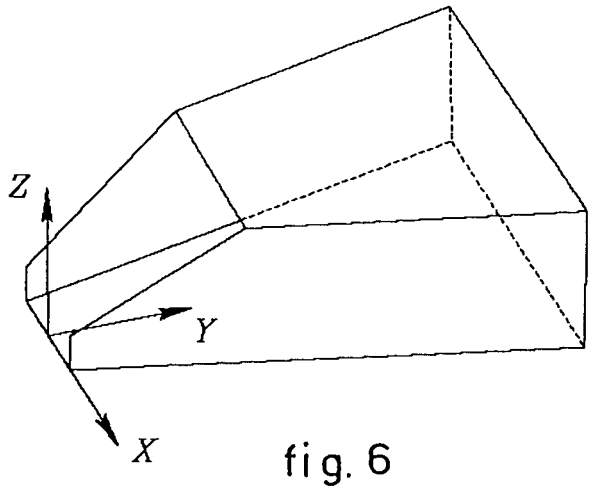
FIG. 6 is a schematic representation of a box of a blade according to the present invention.
Figure 9:
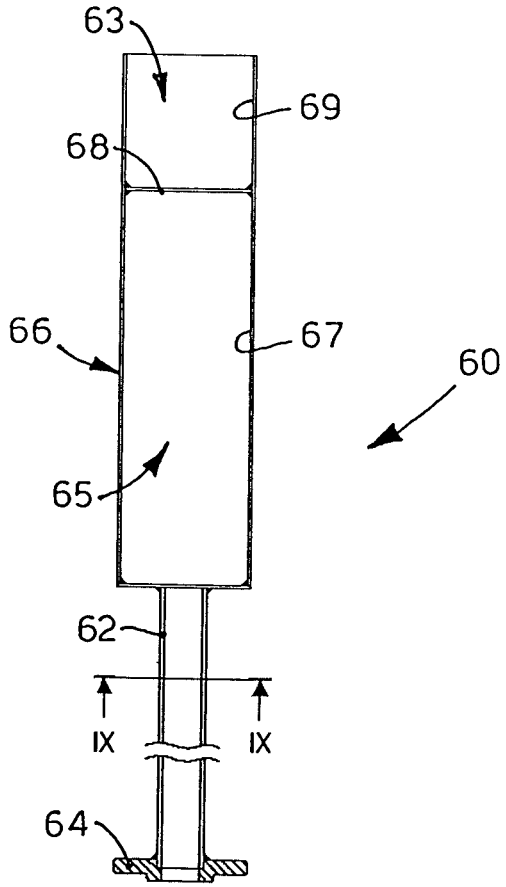
FIG. 9 is a schematic representation of a blade for throwing powders in a mold for the production of blooms or slabs.
Figure 10:
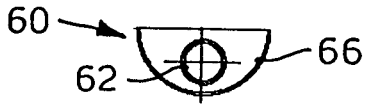
FIG. 10 is a section from IX to IX of FIG. 9.

Blade 60 for Blooms or Slabs (FIGS. 6, 9 and 10)

In general, a first blade 60 developed by Applicant has a flange that allows it to be attached to the wrist of the robot manipulator 32, and a rod or bar at the top of which a box-like body or box is welded, to transport the powders (FIG. 6); the tool is advantageously made of steel, or alloys thereof, or aluminum or other suitable metals.

400 mm Blade

In some forms of embodiment, the rod of the first blade has a length of 200 mm and the overall length is 400 mm. For other needs, the tool can be longer.

750 mm Blade

If it is not possible to guarantee ranges sufficient to cover the whole meniscus using the 400 mm blade, Applicant proposes a larger tool, 750 mm, able to reach the more remote zones of the mold (blade shown schematically in FIGS. 9 and 10).

The 750 mm blade 60 comprises a rod or bar 62 which, at a first end, has an attachment flange 64 attaching it to the articulated arm 34 of the manipulator 32 and, at a second end, a box-like body or box 66, to contain the powders.

The box-like body or box 66 has a substantially semi-cylindrical conformation (FIG. 10), and is divided transversely with respect to its main axis by means of a dividing wall 68 located at a desired distance from the bar 62. The dividing wall 68 divides the box-like body or box 66 into a first sector, or first main chamber 67, closer to the bar 62 and larger, to distribute a first quantity of powders by pouring or throwing them laterally and whip-wise, and a second sector, or second head chamber 69, in a position opposite the bar 62, smaller than the first sector, for example about a quarter of the overall length of the box-like body or box 66, to distribute a second quantity of powders by means of a frontal throw.

In the course of the second movement of frontal throwing of the second quantity of powders contained in the second chamber 69, the dividing wall 68 prevents the first quantity of powder contained in the first chamber 67 from also coming out, as this must be preserved so as to be used in a first movement of pouring or lateral and whip throwing.

The box-like body or box 66 has an upper opening 65 which involves both the first chamber 67 and also the second chamber 69, so the powders can pass and be reloaded. Moreover, a front or head opening 63 is provided in the second chamber 69, for the frontal throwing of the powder.

As we said, the design of the 750 mm blade 60 must respect the load limits for the wrist of the manipulator structure 32. If the manipulator 32 has a limited capacity, that is, if it does not allow the movement of tools that are too long, Applicant has devised a blade with a box with a double chamber, that is, the first sector 67 and the second sector 69, a central one to pour the powder into the reachable points, and the other, open at the head (head-wise opening 63) to throw the powder and allow to cover the inaccessible zones.

The box also combines an adequate capacity with a weight that does not overload the wrist of the manipulator 32. The material chosen for the construction is rolled steel with a thickness of 1 mm, or it may be aluminum or other suitable metal.

Throwing Trials on the Mold

Using the 400 mm or 750 mm blade 60 required a series of trials to determine the distribution characteristics of the casting powders. The throws were made directly on the mold 18.

Types of Throw

Frontal Throw

Figure 7:
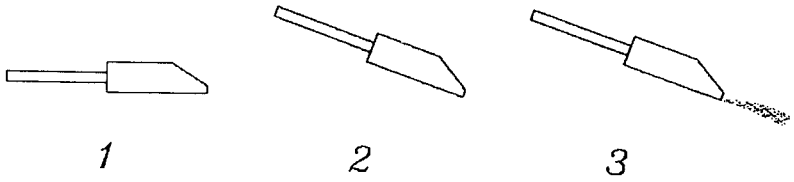
FIG. 7 is a schematic representation of a first throwing technique with a frontal throwing movement.

A first technique (FIG. 7) is the frontal throw, which provides to start with the blade horizontal and to make a longitudinal movement with a simultaneous rotation around the axis X (FIG. 6) of the tool reference system, to be concluded at half-travel, and then to continue with the orientation assumed until the material is detached. This choice allows not to lose material from the box in the initial steps and to impart a certain thrust on the casting powder, which would not happen if the blade were kept always horizontal.

In particular, the technique with the frontal throw using the 750 mm blade 60 provides to fill the second sector or second head chamber 69, and starts with the blade horizontal and makes a longitudinal movement so as to thrust the powder with the dividing wall 68 of the two chambers 67, 69. This technique is used to cover the zones farthest from the robot manipulator 32; compared to the movement made, however, with the 400 mm blade, the tool is kept horizontal for the whole travel. With the 750 mm blade a substantial increase in the length is obtained with respect to frontal throws onto the mold with the 400 mm blade, even though the detachment position is farther forward; this is due to the fact that the longer tool allows the manipulator to work farther inside the operating space, where the speeds required from the joints are lower, thus allowing to obtain higher detachment speeds.

Lateral Throw

Figure 11:
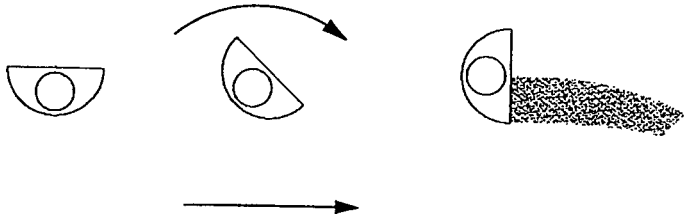
FIG. 11 is a front view of the lateral throwing movement.
Figure 12:
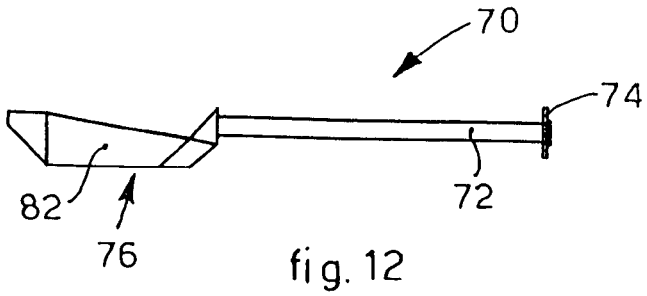
FIG. 12 is a lateral view of a variant of a blade for the distribution of powders in a mold for the production of billets.
Figure 13:
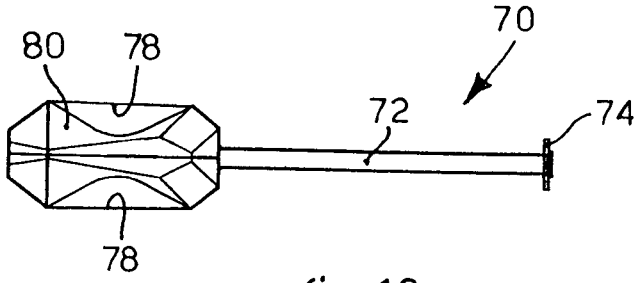
FIG. 13 is a plane view from above of FIG. 12.
Figure 14:
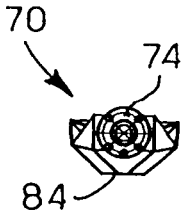
FIG. 14 is a rear view of FIG. 12.
Figure 15:
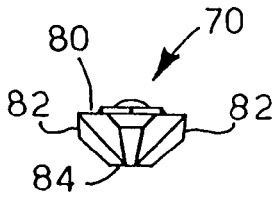
FIG. 15 is a front view of FIG. 12.
Figure 16:
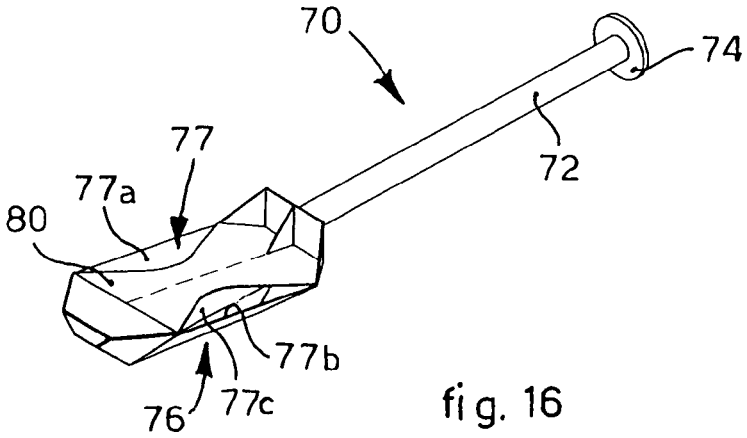
FIG. 16 is a three-dimensional view of FIG. 12.

With the 750 mm blade it is also possible to adopt a lateral throw technique, which provides a transverse forward movement of the blade with a simultaneous rotation of the box (FIG. 11).

Whip Throw

Figure 8:
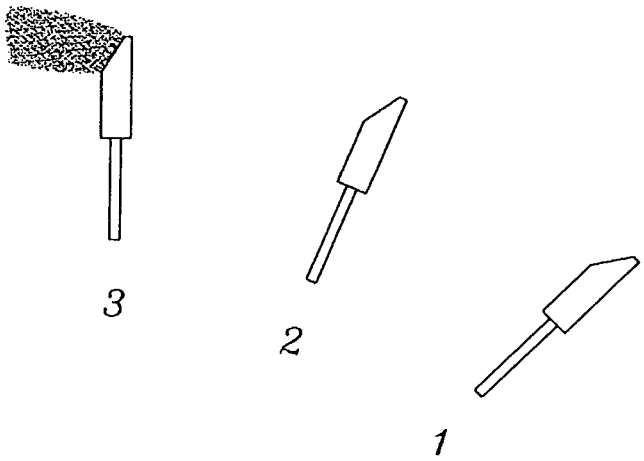
FIG. 8 is a schematic representation of a second throwing technique with a whip throwing movement.

Another technique is the whip throw (FIG. 8), which provides to position the blade so that the lateral face of the box is parallel to the surface on which the throw is made. The TCP (acronym for Tool Center Point, denoting the origin of the tool reference system) in this case performs a circular trajectory with a radius of 1250 mm, covering an arc of 45°. In particular, with the 750 mm blade it is possible to make a whip throw, quite similar to the lateral throw, with the difference that the TCP describes a circular trajectory instead of a rectilinear one.

Results

The 750 mm blade is long enough to include all the zones of the mold in the operating space of the manipulator. However, since the bulk of the box-like body or box 66 and the counterweight, together with the difficult environmental conditions of the real plant, make it advisable to keep the wrist of the manipulator 32 as far as possible from the mold 18, it is possible to reach the more remote zones with throws rather than simply by pouring. The 750 mm blade allows to cover the whole area desired, using the appropriate throwing techniques described above.

Blade 70 for Billets (FIGS. 12, 13, 14, 15 and 16)

In the distribution of powders in molds for the production of billets, since the meniscus of the steel bath in the mold is smaller, it is sufficient to pour the powders in a timed manner, and there is no need to view occluded zones, as defined in detail hereafter.

The blade used, shown in FIGS. 12, 13, 14, 15 and 16 and indicated by the reference number 70, has a bar 72 that, on a first end, has a flange 74 to attach it to the articulated arm 34 of the manipulator and, on a second end, a box-like body or box 76 to contain the powder.

The box-like body or box 76 has an elongated shape and an upper wall 80 which prevents any unwanted leakage of a great part of the powder during the covering movements, lateral walls 82 and a bottom wall 84, which together delimit an internal seating or chamber 77 divided longitudinally by means of a dividing wall 77*c* into two lateral longitudinal compartments 77*a*, 77*b* (FIG. 16), to contain a first and a second quantity of powder, provided in correspondence with relative apertures, such as slits or windows 78, in this case two in number, made through at the edges of the upper wall 80. The desired quantity of powder is poured through the windows 78 using a movement of lateral inclination similar to the one shown in FIG. 11, or it is reloaded by means of delivery tubes 47. The elongated shape of the apertures 78 allows the blade to be easily emptied.

The dividing wall 77*c* is disposed aligned with the longitudinal axis of rotation of the box 76 around which the latter is moved from one side or the other so as to distribute the powder selectively in the two directions.

The conformation of the upper wall 80 and the dividing wall 77*c* prevents a second quantity of powder contained in a second lateral longitudinal compartment 77*b* from exiting undesirably in the course of a first covering movement by which a first quantity of powder contained in a first lateral longitudinal compartment 77*a* is distributed, keeping said second quantity of powder for a second covering movement, different from the first covering movement, and vice versa.

In some forms of embodiment, the chamber 77 can contain from 40 to 300 grams of powder in all, advantageously 50-100 grams.

The blade 70, as we said, is used simply for pouring, and is positioned on each occasion on a desired zone of the mold 18 and rotated around the longitudinal axis of the box-like body or box 76 so as to pour only the quantity of powder required on each occasion on one side or the other according to the direction of rotation.

In some forms of embodiment, it is also possible to provide a blade that has the characteristics of both the blade 60 and the blade 70, therefore providing a front aperture for the frontal throws from a front chamber, and two longitudinal compartments for pouring the powder and/or the whip or lateral throw.

2.2 Robotic Task

In some forms of embodiment, the functioning of the robotic application that governs the manipulator 32 is based for example on three processes that operate in concurrence and deal with the communication with the viewing system and the movement of the manipulator.

Pose Communication Task

The first communication task is to support the calibration of the camera 42.

Second Communication Task

This task operates in synchrony with the successive movement task, and deals with requesting from the viewing system the coordinates of the point to be covered.

Movement Task

The movement task has inside it the whole code that deals with the movement of the manipulator 32.

Movements of the Manipulator 32

The trajectories performed by the manipulator 32 in the operating space are described by poses that can be expressed in different systems of coordinates. The manipulator 32 works especially near the mold 18.

Division of the Mold 18

An exposure is covered according to different types of movement of the distribution tool or blade 60, 70; the choice of the most suitable type is based on the area where the point to be serviced lies. The mold 18 is therefore divided into multiple zones, and a specific distribution movement is associated with each one of them, a pouring movement or a throwing movement as described above, but in any case the need not to bring the blade 60, 70 too near the snorkel 16 is taken into account.

The number of zones into which the mold 18 is divided depends on the type of product: blooms, slabs or billets.

Figure 17:
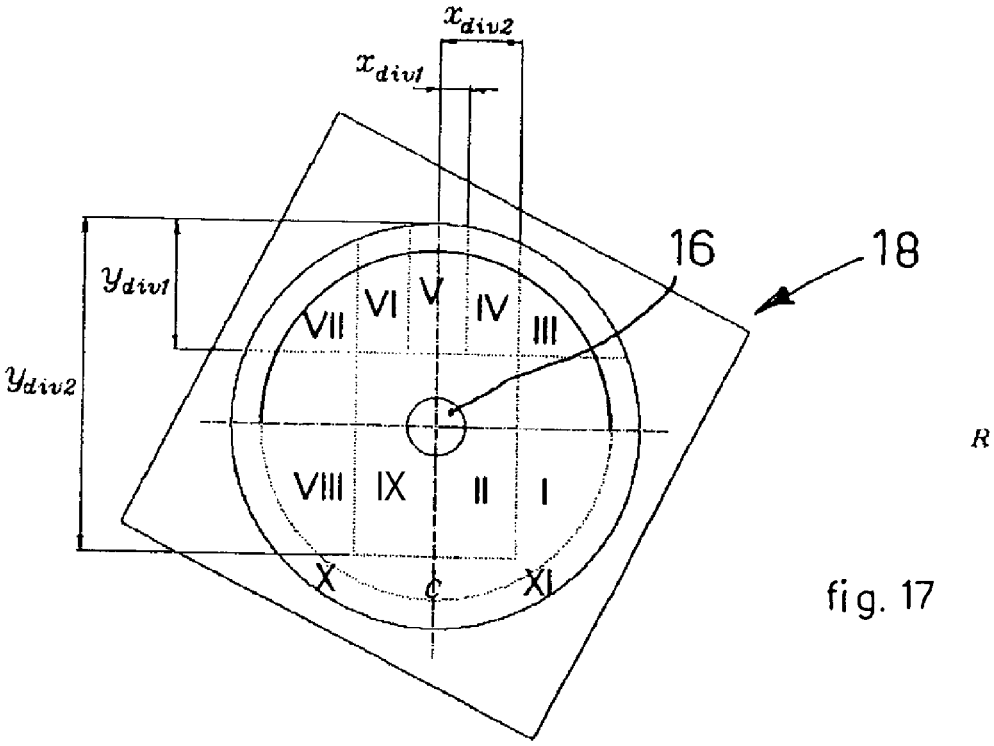
FIG. 17 shows a logical division diagram of the mold to choose the covering movement.

For example, in the case of large section blooms, the mold 18 is divided into eleven zones I, II, III, IV, V, VI, VII, VIII, IX, X, XI, with each of which a specific distribution movement is associated. FIG. 17 shows the division made in this specific case, which is not to be understood as a limitation of the field of protection of the present invention, where the central circle indicates the snorkel 16.

The constants that allow to delimit the borders of the zones are shown in the following Table.

| Symbol [/] | Value [mm] | Meaning [/] |
|---|---|---|
| $R_l$ | 350 | Radius of the mold |
| $r_t$ | 50 | Radius of the snorkel |
| $X_c$ | 0 | Abscissa center snorkel-mold |
| $Y_c$ | 350 | Ordinate center snorkel-mold |
| $X_{div1}$ | 50 | See FIG. 17 |
| $X_{div2}$ | 140 | See FIG. 17 |
| $Y_{div1}$ | 225 | See FIG. 17 |
| $Y_{div2}$ | 575 | See FIG. 17 |
| $C_e$ | 50 | Amplitude zones X and X1 |

Covering Movements

The robot manipulator 32 loads the box-like body or box 66 of the tool or blade 60, 70 into the reloading point R and, when the reloading operation is concluded, moves toward the common point C; the location of the points R and C inside the system is shown in FIG. 17. Afterwards, the manipulator 32 moves the blade 60, 70 toward an approach point, that is, a point from which the covering movement proper is made, located near the edge of the mold and calculated according to the region where the area or zone to be serviced lies; finally, it makes the covering movement proper, by pouring or throwing the powder. The function of point C is to separate the reloading operations in the reloading position R from the operations to distribute the powder in the zones that have to be serviced.

Zones I and VIII

These zones are found in areas of the mold 18, in a substantially front position with respect to the blade 60, 70, not occluded by the snorkel 16 and can be reached by the blade 60, 70 easily and in relative safety; therefore, it was chosen to service them by pouring the powder vertically above the exposure found. This choice is one of the many possible choices, depending on the shape of the mold.

From the common point C the manipulator takes the blade 60, 70 to an approach point which has the same abscissa as the one to be serviced, and an ordinate such as to position it on the edge of the mold; from here, the abscissa and ordinate of the exposure being called $x_e$ and $y_e$, it moves it to take the center of the first main chamber 67 above the exposure, at this instant the pouring proper begins. The pouring occurs as the object reference system moves by a desired distance along the axis X, that is, distancing itself from the snorkel 16; at the same time the blade 60, 70 is rotated by ±145° with respect to the axis Y of the tool trio, so as to allow the load to come out. The approach speed and the pouring speed are respectively 500 mm/s and 100 mm/s.

The following pseudocode achieves the above for an exposure in zone I.

```
...
approach:=calculate_approach(x_e, y_e);
start.x:=x_e+15;
start.y:=y_e−125;
final.x:=x_e−45;
final.y:= y_e−125;
MoveTo approach;
MoveTo start;
MoveTo final;
MoveTo start;
...
```

Zones II and IX

Zones II and IX surround the snorkel 16 and are close to it: therefore they must be serviced by movements that keep the blade 60, 70 distant enough from this element; the technique decided upon was lateral throw. The approach point in this case has the same ordinate as the point to be serviced and has the abscissa such as to locate it on the edge of the mold on the side of the zone concerned; from here it moves toward the point that represents the beginning of the throw proper, which develops taking the distribution tool or blade 60, 70 to a determinate point along the distance that separates the detachment point from the point to be covered and by rotating it simultaneously by ±90° with respect to the axis Y of the tool trio (FIG. 6). When the throw is completed the manipulator 32 heads to the reloading position R, following the same trajectory in reverse. The speed of the lateral throw is 1000 mm/s.

The following pseudocode describes the movement in zone II.

```
...
approach:=calculate_approach(x_e, y_e);
start.x:=x_e−325;
start.y:=y_e−125;
MoveTo approach;
MoveTo start;
MoveTo Offset(start ,200,0,0);
MoveTo start;
...
```

Zones III and VII

Zones III and VII, compared with zones I and VIII, are symmetrical and in a position opposite the snorkel 16. In order not to bring the wrist of the robot manipulator 32 too close to the body of the mold 18, it was decided to cover these zones by loading the second head chamber 69 of the blade 60, 70 and then use the front throw technique. The manipulator 32 takes the tool toward the approach point, calculated as in the case for zones I and VIII, and from here to a point that constitutes the initial point of the trajectory; the detachment is located in a position such as to be separated by 200 mm from the point to be covered; this value was chosen according to the distribution characteristics guaranteed by this movement. The speed set to perform the front throw is 2500 mm/s.

The following pseudocode implements the trajectory needed to service both zones III and VII.

```
...
approach:=calculate_approach(x_e, y_e);
start.x:=x_e+350;
start.y:=y_e;
MoveTo approach;
MoveTo start;
MoveTo Offset(start ,−150,0,0);
MoveTo start;
...
```

Zones IV and VI

Zones IV and VI, compared with zones II and XI, are symmetrical and in a position opposite the snorkel 16. The movements relating to zones IV and VI are identical to those relating to zones III and VII, with the difference that the trajectory is rotated by ±25° around the axis Z of the object reference system, in order to prevent an excessive proximity of the blade 60, 70 to the snorkel 16.

Zone V

Zone V is the most difficult one to reach because, with respect to the position of the manipulator 32, it is exactly behind the snorkel 16. If we want to avoid taking the wrist of the manipulator 32 above the mold 18, it is not possible to use frontal or lateral throws; among the tried techniques only the whip throw remains available. It guarantees somewhat ample distributions with respect to the area of zone V, which make it useless to calculate the trajectory as a function of the coordinates of the point to be covered. Therefore, it was decided to implement only two approach strategies, chosen according to the ordinate of the exposure. The three points necessary to characterize them in the object reference system are shown in the following Table.

| | | Position (mm) | | | Orientation (°) | | |
|---|---|---|---|---|---|---|---|
| Condition | Point | x | y | z | ϕ | θ | ψ |
| $y_e \le \frac{y_{div1}}{2}$ | Initial Point | −559.7 | 353.7 | 30.0 | 50.0 | 0.0 | 0.0 |
| | Average Point | −436.5 | 230.5 | 30.0 | 40.0 | 0.0 | −45.0 |
| | Final Point | −293.7 | 130.5 | 30.0 | 90.0 | −60.0 | −90.0 |
| $y_e > \frac{y_{div1}}{2}$ | Initial Point | −559.7 | 466.2 | 30.0 | 50.0 | 0.0 | 0.0 |
| | Average Point | −436.5 | 343.0 | 30.0 | 40.0 | 0.0 | −45.0 |
| | Final Point | −293.7 | 243.0 | 30.0 | 90.0 | −60.0 | −90.0 |

From the common point, the blade 60, 70 moves toward the initial point, from which it starts to follow a trajectory like an arc of a circumference with an amplitude 20° with a simultaneous rotation of the box by 90° with respect to the axis Y of the tool reference system. The speed set to perform the whip throw is 2000 mm/s.

The following pseudocode list describes the above.

```
...
IF y<=y_div_1/2 THEN
    MoveTo p_initial;
MoveTo p_average ,Offset p_final ,0,0,0);
MoveTo p_initial;
    ELSE
        MoveTo Offset(p_initial ,0 ,y_div_1/2 ,0);
```

-continued

```
MoveTo Offset(p_average ,0 ,y_div_1/2 ,0);
MoveTo Offset(p_final ,0 ,y_div_1/2 ,0);
MoveTo Offset(p_average ,0 ,y_div_1/2 ,0);
MoveTo Offset(p_initial ,0 ,y_div_1/2 ,0);
    ENDIF
...
```

Zones X and XI

Zones X and XI, determined in substantial correspondence with the edge of the mold 18, could be serviced through pouring operations similar to those used for zones I and VIII, but agreeing to pour a significant part of the powder load outside the mold; if we want to reduce waste as much as possible, it is necessary to adopt some other technique, such as for example a lateral throw made toward the edge of the mold and not toward the inside of the bath.

The speed at which the powders are thrown is 500 mm/s, enough to reach the edge of the mold.

The movements relating to zone XI are shown in the following list.

```
...
approach:=calculate_approach(x_e, y_e);
start.x:=x_e+175;
start.y:=y_e−125;
IF y_e<=500 THEN
MoveTo approach;
MoveTo start;
MoveTo Offset(start ,−75,0,0);
MoveTo start;
...
ELSE
    ...
ENDIF
```

3) Viewing System 3.1) Calibration of the Camera 42

In order to associate the points of the scene with the pixels that form an image, it is necessary to determine the geometric model of the camera 42.

Perspective Model

Based on the components of the geometric model of the camera, it is possible to define a transformation that describes the perspective projection of one point of the scene onto the image plane.

DLT Calibration Method

Using a calibration method it is possible to estimate the elements of the calibration matrix setting aside their physical meaning but using the correspondence between determinate points, known both in the real reference system and also on the image plane.

The DLT calibration procedure relies on a gig having markers that are easily removable from the images acquired and put in a known position in the world reference system. The positioning is achieved by the manipulator which therefore supplies the complete pose.

The accuracy with which the position of the markers in the image is identified plays a fundamental role in the quality of the result of the calibration.

Mold-Based Calibration Method

The mold-based calibration method proposes to estimate the perspective projection matrix starting from an observation of the edge of the mold 18. The Applicant advantageously uses the mold-based method to make the whole system more robust with respect to small displacements of the camera.

The method consists in identifying the position of the camera 42 by observing the mold 18 and then making the pose univocal with the latter. The position of the robot 32 with respect to the mold 18 is mechanically known. In this way the geometry of the system is completely known.

3.2) Detection of the Exposures

The task of the viewing system is to detect the zones of the bath where an exposure to the air of the steel meniscus is formed due to the consumption of the casting powder, and to communicate to the robot manipulator 32 the need to cover it.

The present invention proposes a detection technique that uses a process of transforming position information from the image plane to the plane of the mold 18, also obviating the problem of occlusions of the bath.

Discernment of Flames-Exposures

The task of the viewing system camera 42-computer 54-monitor 56 is to detect the zones of the bath where there is a lack of casting powder; since the steel is incandescent, such exposures have a high light intensity which is not, however, sufficient to characterize them. Indeed, flare-ups are formed in a random manner on the free surface of the steel and have similar characteristics.

In general, therefore, a method is proposed intended to distinguish the exposures from the flames: it calculates the mean and standard deviation of each individual pixel on a certain time window, discarding all the elements that do not simultaneously have high intensities and low variabilities.

In particular, with the passing of time, the powder present on the free surface of the steel is gradually consumed, exposing the incandescent alloy to contact with the air. The exposures have a light intensity that makes them stand out strongly from the context; however, a simple point-by-point analysis based on a single shot is not sufficient to identify them. In fact, in the working process the flames that are frequently generated on the surface have intensity characteristics such that, when a single image is worked on, make them indistinguishable from exposures proper. Since the flames do not compromise the quality of the product, it is desired to identify the exposures alone; in order to achieve this purpose a temporal processing of several images, or video frames, acquired at later times, is therefore necessary.

By observing the development over time of the intensity of some pixels which the human observer manages to distinguish as belonging to an exposure or to a flare-up, it can be seen that the variability of the latter is considerably higher.

The best filtering technique is obtained by an M-SD filter.

M-SD Filtering

Applicant used an M-SD (Mean-Standard Deviation) filter which provides to calculate the trend of the mean $\mu_{(u;v)}(t)$ and standard deviation $\sigma_{(u,v)}(t)$ of the intensity of the pixels, on a given time window with an amplitude $\tau$. This last quantity $\sigma_{(u;v)}(t)$ differs considerably between flames and exposures and it is possible to use this in order to achieve the purpose.

The filter calculates the mean and standard deviation of the intensity of each pixel on a video sequence of a few frames. Subsequently it effects a thresholding by putting all the pixels with a mean intensity more than a certain threshold $\sigma_\mu$ as equal to one (1), and the standard deviation is less than another threshold $\sigma_\sigma$.

In the result obtained from the filtering operation, the snorkel 16 still appears in the processed image because the development of the intensity of the pixels on which it is projected is analogous to that of the exposure pixels. However, since its position inside the system 30 is known, it is possible to exclude the corresponding pixels of the image from subsequent processing, thanks to the perspective projection matrix.

Some of the flame pixels may not be suppressed by the filtering operation. However, there are few of them and relatively sparse, and therefore it is easy to eliminate them thanks to a morphological analysis that calculates the area of the regions present. The centroids of the zones that pass this further selection are only those relating to the exposures looked for.

Projection on the Plane of the Mold 18

The centroids of the exposures identified in the image plane must be re-projected into the scene so as to provide the robotic system of the manipulator 32 with the information needed to perform its task. This operation must take into account the fact that infinite points of the scene exist, which are projected in the same pixel of the image. They are all those points which lie on the line passing through the projection and through the optical center. The inverse problem may be solved since the plane on which the exposures lie is known in advance, that is, the one shown by the free surface of the steel. The only solution admissible is therefore given by the intersection between the plane of the mold and the optical radius concerned, that is, the line passing through the optical center and through the point identified on the image plane.

Occlusions

The present invention proposes to overcome the disadvantage of covering the points on the bath that are not visible to the camera 42 due to the presence of the edge of the mold 18 and the snorkel 16. As can easily be understood, not all the surface of the mold 18 can be seen by the camera 42. There are fundamentally two elements that concur to form the shadow zones: the snorkel 16 and the part of the edge of the mold 18 facing the camera 42. Other elements too, such as the box of the blade 60, 70, or the counterweight, could also interfere with the view, but they will not be considered since the invention provides to position the camera 42 on the articulated arm 34 (FIG. 20) in such a way that this possibility does not occur. It is therefore necessary to ensure that the occluded zones can also be covered.

Generally speaking, the solution proposed identifies the occluded zones and inserts in the queue of exposures to be serviced some points that belong to them, chosen in a pseudo-random manner, with a frequency proportional to the ratio between the non-visible area and the total area; the experimental trials carried out have shown that this way of proceeding allows to completely cover the bath with a number of services lower than that required by inserting the ordinate points in a queue. The first step is therefore to identify the snorkel 16 and the edge of the mold 18.

Identifying the Snorkel 16

Identifying the snorkel 16 provides to extract its edges from the images collected; this approach is very flexible since it adapts to locations of the snorkel 16 outside the nominal position. The complexities emerge when one tries to identify the edge at the height of the free surface of the steel; in fact, if the exposures were close to the snorkel 16, as often happens, it would not be possible to perform the detection due to the analogous intensity that characterizes the pixels of the exposure and the pixels of the snorkel.

The problem can be overcome in any case by exploiting the fact that the coordinates of the points belonging to the edge of the snorkel 16 and the height of the free surface are known. Therefore, based on the geometric knowledge of the snorkel 16, its surface is expressed and the points of greatest interest are identified, which are those at the heights of the free surface of the steel and the box of the blade 60, 70; from these points, projected onto the image by means of the techniques described above, the desired correspondences are obtained. By connecting the points it is therefore possible to show the profile of the snorkel 16 and thus complete its extraction.

Edge of the Mold 18

The position of the mold 18 is known and fixed in the reference system of the system, therefore the edge can be detected geometrically. It is possible to express its equation in the same way as was done for the snorkel 16. With regard to the height, the relevant points are in correspondence with the edge and the part in contact with the free surface of the steel. By projecting the points into the image and extracting only the portion facing toward the camera 42, the part of the edge that obscures the bath is emphasized.

Covering the Occluded Points

Figure 18:
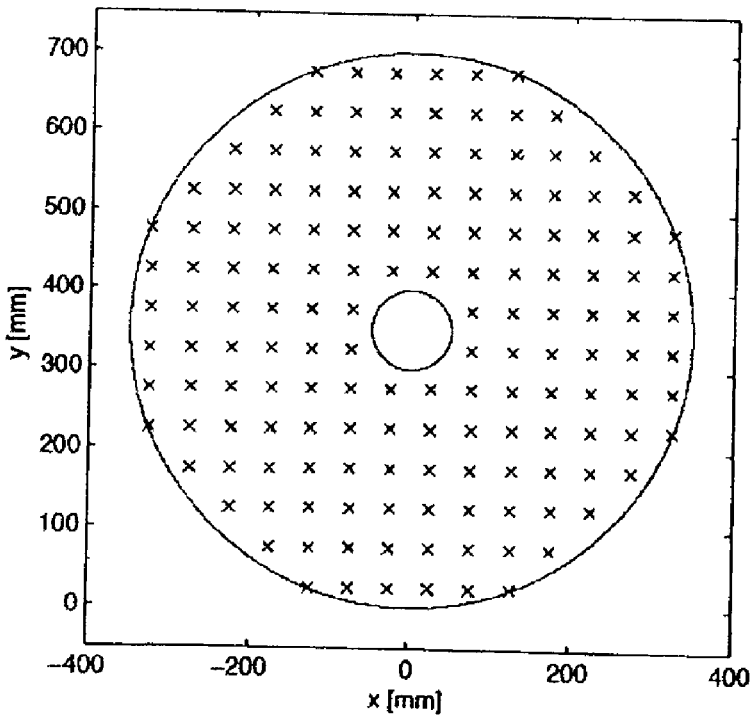
FIG. 18 is a representation of the distribution of the trial points on the surface of the mold with a 50×50 mm grid.

In order to service the hidden zones adequately, a grid or matrix of test points was taken into consideration, lying on the free surface of the bath of molten steel to be projected onto the image plane associated with the image acquired, to see if they are part of the occluded regions or not. An example of their disposition with a grid or matrix of 50×50 mm is shown in FIG. 18.

The ratio v between the number of points in shadow and the total points, calculated by the controller 40, provides an indication of the entity of the occluded regions, directing the choice of the frequency with which to service them. The law for filling the queue of points waiting to be covered by the manipulator 32, set on the controller 40, provides that for every n elements (for example 10 elements), there are $p_v$ visible and $p_o$ occluded, where $p_v=(1-v)*n$ and $p_o=v*n$.

Given the unpredictability with which the exposures are formed, the non-visible points that have to be inserted in the queue are chosen in a pseudo-random manner. The order in which they are serviced is calculated at the start of the application which manages the work queues on the controller 40, through a random permutation of the table of ordered data (array) which typically contains their known coordinates; once a point is serviced, it is returned to the queue. This solution allows to service the shadow zones in a cyclical and homogeneous manner, preventing accumulations of casting powder which there would be, for example, if the occluded points were covered in succession near each other.

Since the coordinates of all the points on the grid, visible and occluded, are known, the above filling law, in combination with the pseudo-random intervention criterion, provides the frequency with which occluded points, randomly selected, must be subjected to a covering operation.

The application program of the controller 40 that manages the work queues and the operations of the robot manipulator 32 processes cyclically the information relating to the frequency of intervention on the occluded zones with respect to the visible zones, acquired by processing images of the mold 18 detected over time by the camera 42, and creates a desired pseudo-random work queue of the occluded points to be covered.

For example, if the value of the ratio v is high, this means that there is a high number of occluded points, with known coordinates, to be serviced with respect to the visible points. The actual occluded points that are serviced in a cycle will be chosen in a pseudo-random manner and subjected to a covering cycle. The reliability of the method is based on the fact that, since the number of exposures on a given temporal base is statistically known, the homogeneity of the intervention on occluded points, on the same temporal base, is guaranteed by the pseudo-random choice of the coordinates of the occluded points to be serviced.

Experimental Trials

In order to test the effectiveness of this method, trials were carried out with the camera 42 mounted on the shoulders of the manipulator 32 in a position such as to guarantee v=0.51, that is, in this case seventy-seven occluded points out of the one hundred and fifty two trial points; the service frequency in these conditions is five exposures and five occluded points. For the trial a wooden model of the mold 18 was used, where the visible part of it was covered by casting powder, leaving exposed only five points; the occluded zones, on the contrary, were left totally uncovered.

The application program was then made to run until all the occluded zones were covered. The data detected show the following facts:

- the trial points are distributed in such a manner as to guarantee that all the occluded or non-visible zones are covered;
- by choosing the order of service of the occluded zones with the method proposed, the complete cover can be achieved more quickly than by covering them in succession near each other;
- if the occluded zones were serviced one after the other, accumulations of powder would be formed in certain zones of the mold, leaving certain other zones uncovered and thus invalidating the quality of the product.

It is clear that modifications and/or additions of parts may be made to the robotized system for managing the powders in a plant for the continuous casting of steel as described heretofore, without departing from the field and scope of the present invention. It is also clear that, although the present invention has been described with reference to some specific examples, a person of skill in the art shall certainly be able to achieve many other equivalent forms' of robotized system for managing the powders in a plant for the continuous casting of steel, having the characteristics as set forth in the claims and hence all coming within the field of protection defined thereby.

The invention claimed is:

1. A method to cover the exposures of a bath of molten steel by means of casting powder in an ingot mold of a plant for continuous casting of steel into which, by means of a snorkel disposed in a substantially central position in the mold and connected to a tundish, the molten steel is introduced, comprising:

- detecting zones of exposures of the molten bath of the ingot mold where there is a lack of casting powder by acquiring images and/or video sequences of the surface of the bath of molten steel of the mold to identify said exposures on the basis of their high light intensity with respect to the casting powder;
- subdividing the ingot mold into a plurality of zones (I, II, III, IV, V, VI, VII, VIII, IX, X, XI), with each of which a determinate type of covering movement is associated, performed to distribute the powder on the detected exposures, said zones (I, II, III, IV, V, VI, VII, VIII, IX, X, XI) being determined and identified in a manner coordinated with a position of the snorkel and of an edge of the ingot mold, determining at least zones (I, VIII) distanced from the snorkel and near the edge of the mold, zones (II, III, IV, VI, VII, IX) near the snorkel with respect to the edge of the mold and/or in a position opposite the snorkel with respect to a desired common point (C) of the mold, and at least a zone (V) which is opposite and behind the snorkel with respect to the common point (C);
- automated execution of one or more covering movements by means of which the casting powder is distributed in a selected one of said zones (I, II, III, IV, V, VI, VII, VIII, IX, X, XI), which movements, repeated in sequence according to a desired program, are selected from a group of pouring movements and throwing movements, at least on the basis of a reciprocal position of each of said zones (I, II, III, IV, V, VI, VII, VIII, IX, X, XI) and the snorkel, said covering movements being performed starting from said common point (C) of the mold, displacing the powder from said common point (C) toward an approach point selected to have at least a first spatial coordinate which disposes it on the edge of the mold and a second spatial coordinate in common with the region of the mold in which the zone (I, II, III, IV, V, VI, VII, VIII, IX, X, XI) to be serviced is found, and a final covering movement is performed from said approach point;

wherein the method provides both a step of displacement into a re-loading position (R) where a step of re-loading the powder is carried out, and also, once the re-loading step is finished, a step of displacement to said desired common point (C) of the ingot mold, from which said covering movements are again carried out;

said method also providing to discern detected exposures with respect to flames, sparks or other visual disturbances present on the bath of molten steel, effecting:

applying a technique for temporal non-linear filtering of pixels of the acquired images, based on M-SD (Mean-Standard Deviation) filtering, which provides to calculate development of the mean and standard deviation of the intensity of every pixel, on a temporal window of desired amplitude and a thresholding, wherein the points relating to all the pixels whose mean intensity is higher than a determinate threshold value and whose standard deviation is less than a further determinate threshold value are considered exposed.

2. The method as in claim 1, wherein at least the zones (II, III, IV, VI, VII, IX) near to the snorkel with respect to the edge of the mold and/or in a position opposite the snorkel with respect to said common point (C) of the mold, or the zone (V) opposite and behind the snorkel, are covered by movements of throwing the powder.

3. The method as in claim 1, wherein said throwing movements comprise front throwing, lateral throwing or whip throwing.

4. The method as in claim 3, wherein to cover the zone (V) obscured or eclipsed by the snorkel, the method carries out whip throwing movements.

5. The method as in claim 1, wherein to discern exposures with respect to flames, sparks or other disturbances of the bath of molten steel, a temporal processing is provided of several images acquired at successive times, calculating the mean and standard deviation of the intensity of every pixel on a video sequence of some frames and performing a thresholding by putting as equal to one all the pixels with a mean intensity of more than a certain threshold $\sigma_\mu$ and with a standard deviation of less than another threshold $\sigma_\sigma$, wherein the pixels of the image relating to the snorkel that still appears in the processed image are eliminated from the subsequent processings based on the known spatial position of the snorkel, due to the use of the perspective projection matrix associated with the mold.

6. The method as in claim 1, wherein the plant for the continuous casting of steel is conformed to identify and cover occlusions or non-visible zones of the bath of molten steel, comprising:

in at least one said acquired image of the surface of the molten bath, identifying both visible zones and occluded zones which comprise at least shadow zones defined by the snorkel and by the edge of the ingot mold, on the at least one said image acquired, by extracting the edges of the snorkel and the edge of the ingot mold from the acquired image;

defining a matrix of test points lying on the free surface of the bath of molten steel and projected onto an image plane associated with the at least one said acquired image, said points all being associated with univocal spatial coordinates, known and defined in advance;

counting the points belonging to the visible zones;

determining the value of a ratio v between the number of points included in the occluded or non-visible zones, and the overall points n of the matrix of the test points, to provide an indication of the entity of the occluded zones to guide the choice of the frequency with which these are covered;

defining a law for filling a work queue of points waiting to be covered with the casting powder, which filling law provides that, as a function of said ratio v, every n queue elements, there are $p_v$, visible and $p_o$ occluded or non-visible, wherein the choice of the order in which said non-visible points are inserted in said work queue and then serviced to cover the detected exposures is made in a pseudo-random manner, calculated at the beginning of the method by means of a random permutation of the table of ordered data or array, which contains said non-visible points, and wherein, once a point is covered, the point is returned to the queue, to determine a cyclical and homogenous covering of the occluded zones.

7. The method as in claim 6, wherein the values of $p_v$ visible and $P_o$ occluded are calculated by means of the following formulas:

$$-p_v=(1-v)*n;$$

$$-p_o=v*n.$$

8. The method of claim 1, comprising providing a tool to distribute the powders, associable with a robotized manipulator, to carry out each said determinate type of covering movement to cover the exposures of the bath of molten steel in the ingot mold, the tool comprising:

a containing body or box with which the casting powder is transported, which distributes the casting powder by pouring or throwing movements, or both of said movements, said containing body or box being divided into a plurality of compartments or chambers which by at least two different covering movements distribute the powder in different zones of the bath of molten steel to be serviced, separation means separating said chambers or compartments from each other, disposing the separation means in a manner coordinated with the type of covering movement associated with at least one of the chambers or compartments, wherein in the course of at least a first covering movement, distributing a first quantity of powder contained in one of said chambers or compartments, during the first covering movement withholding a second quantity of powder, contained in the other of said chambers or compartments to be used in the course of at least a second covering movement, different from the first covering movement.

9. The method as in claim 8, wherein said containing body or box has a first main chamber, open at the upper part, and a second head chamber, open both at the upper part and at the front, distributing the casting powder from the first main chamber with a pouring and throwing movement, and distributing the powder from the second head chamber with frontal throw movements.

10. The method as in claim 9, wherein the first main chamber and the second head chamber are separated by a transverse dividing wall, which functions as a barrier disposed transverse to the direction associated with the frontal throw movement with which the powder is distributed in the second chamber, thrusting forward the powder contained in the second head chamber, facilitating exit of the powder so the powder is thrown through the front opening, at the same time the transverse dividing wall preventing the powder present in the first chamber from coming out at the front.

11. The method as in claim 8, wherein said containing body or box has an internal chamber, divided longitudinally into two compartments by a dividing wall disposed coordinately aligned with the axis around which the containing body or box is rotated during pouring, and an upper wall with upper openings having a shape elongated in the direction of the main development of the containing body or box, through the internal chamber pouring the casting powder onto the bath of molten steel and re-loading the powders, said dividing wall and said upper wall cooperating to withhold the powder contained in one of the two compartments when the powder contained in the other of the two compartments is distributed.

* * * * *

UNITED STATES PATENT AND TRADEMARK OFFICE

CERTIFICATE OF CORRECTION

PATENT NO. : 8,505,612 B2
APPLICATION NO. : 13/522332
DATED : August 13, 2013
INVENTOR(S) : Ferruccio Della Vedova It is certified that error appears in the above-identified patent and that said Letters Patent is hereby corrected as shown below:

In the Claims:

Claim 1, Column 20, Line 39 should read: "A method to cover ~~the~~ exposures of…"

Signed and Sealed this
Fifteenth Day of October, 2013

Teresa Stanek Rea

Teresa Stanek Rea
*Deputy Director of the United States Patent and Trademark Office*